US011953279B2

(12) United States Patent
Risley

(10) Patent No.: US 11,953,279 B2
(45) Date of Patent: Apr. 9, 2024

(54) MUZZLE BRAKE APPARATUS FOR FIREARM

(71) Applicant: Matt Risley, Phoenix, AZ (US)

(72) Inventor: Matt Risley, Phoenix, AZ (US)

( * ) Notice: Subject to any disclaimer, the term of this patent is extended or adjusted under 35 U.S.C. 154(b) by 0 days.

(21) Appl. No.: 17/825,198

(22) Filed: May 26, 2022

(65) Prior Publication Data

US 2023/0078533 A1 Mar. 16, 2023

Related U.S. Application Data

(60) Provisional application No. 63/193,701, filed on May 27, 2021.

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS 9,228,789 B1 * 1/2016 Oglesby ..... F41A 21/36
9,310,152 B1 * 4/2016 Poling ..... F41A 21/36
10,508,878 B1 * 12/2019 Oglesby ..... F41A 21/36
11,397,066 B1 * 7/2022 Oglesby ..... F41A 21/325
2013/0340313 A1 * 12/2013 Myers ..... F41A 21/30 42/90
2014/0216237 A1 * 8/2014 Butler ..... F41A 21/30 89/14.4
2015/0192379 A1 * 7/2015 Larson, Jr. ..... F41A 21/36 89/14.3
2015/0308778 A1 * 10/2015 Vossler ..... F41A 21/34 89/14.3
2016/0076844 A1 * 3/2016 Miller, III ..... F41A 21/30 89/14.3
2016/0370141 A1 * 12/2016 Sy ..... F41A 21/325
2017/0059268 A1 * 3/2017 Sherrill ..... F41A 21/36
2017/0191782 A1 * 7/2017 Bray ..... F41A 21/36
2018/0135933 A1 * 5/2018 Griffitts ..... F41A 21/36
2018/0238654 A1 * 8/2018 Barry ..... F41A 21/36

FOREIGN PATENT DOCUMENTS

WO WO-8602438 A1 * 10/1984 ..... F41C 21/18

* cited by examiner

*Primary Examiner* — Samir Abdosh
(74) *Attorney, Agent, or Firm* — Schmeiser, Olsen & Watts LLP

(57) ABSTRACT

A muzzle brake apparatus comprises a main body having a central bore and a plurality of peripheral bores about the central bore, the central bore extending a flow path for a projectile from a barrel of a firearm and an exit for the projectile and a brake backing plate coupled to the main body, the brake backing plate constructed and arranged for coupling to a distal end of the barrel of the firearm, the brake backing plate including an air chamber that provides an interior volume for receiving a flow of gas in the flow path of the barrel, wherein the peripheral bores output a first portion of gas from the firearm, and wherein a second portion of the gas is returned to the barrel from the air chamber.

14 Claims, 9 Drawing Sheets

MUZZLE BRAKE APPARATUS FOR FIREARM

RELATED APPLICATIONS

This application claims priority to U.S. Provisional Application Ser. No. 63/193,701 filed on May 27, 2021 entitled "MUZZLE BRAKE APPARATUS FOR FIREARM," the entirety of which is incorporated by reference herein.

FIELD OF THE INVENTION

The inventive concepts relate generally to firearms. More specifically, the inventive concepts relate to a muzzle brake system for a rifle.

BACKGROUND

Modern gas-operated firearms, for example, the assault rifle 10 shown in FIG. 1, include a gas impingement system 10 that includes well-known components such as a gas block 22, gas port 24, and gas tube 26, also referred to as a gas line. extending between the barrel 12 and a bolt carrier group 13. During operation, hot gas is routed through the gas port 24 into the gas tube 26. In order to ensure that the gun fires smoothly, the gas impingement system 10 diverts a portion of the hot gas which propels a projectile, e.g., a bullet, from the gas block 22 back to the bolt carrier group 13 to automatically reload a new round of ammunition.

When firing a bullet from a rifle, a majority of the gas (except the gas diverted back to the bolt carrier group 13) exits the muzzle 20, which can result in a substantial recoiling action causing the distal end of the gun 10 to move upward in an unintentional manner, referred to as muzzle jump or muzzle rise. Also, the presence of the muzzle 20 results in a substantial amount of propellant gas into the action, which can cause premature wear and tear on the components and reduce reliability of the gas impingement system due to the pressure spike. In addition, a conventional muzzle 20 typically includes side vents which emits not only gas but undesirable sound energy produced when the propellant in a cartridge is ignited to force the bullet down the barrel 12 and through the muzzle 20. The sound can be quite loud to a neighboring person.

SUMMARY

In one aspect of the present inventive concept, a muzzle brake apparatus comprises a main body having a central bore and a plurality of peripheral bores about the central bore, the central bore extending a flow path for a projectile from a barrel of a firearm and an exit for the projectile and a brake backing plate coupled to the main body, the brake backing plate constructed and arranged for coupling to a distal end of the barrel of the firearm, the brake backing plate including an air chamber that provides an interior volume for receiving a flow of gas in the flow path of the barrel, wherein the peripheral bores output a first portion of gas from the firearm, and wherein a second portion of the gas is returned to the barrel from the air chamber.

In some embodiments, the peripheral bores in the main body have a second volume, and wherein the muzzle brake apparatus includes a volume comprising the first volume and the second volume.

In some embodiments, the air chamber expands a volume of the flow of gas received from the barrel before the first portion of gas enters the peripheral bores.

In some embodiments, the main body has a peripheral surface area that prevents the flow of gas from output through the peripheral surface, and so that the flow of gas can only exit the muzzle brake apparatus from the central bore and the plurality of peripheral bores.

In some embodiments, the peripheral surface of the main body, an interior volume of the main body, and the cavity of the brake backing plate each has a non-circular shape.

In some embodiments, the non-circular shape of the peripheral surface of the main body accommodates a positioning of a handguard of the firearm about the main body.

In some embodiments, an arrangement of a plurality of peripheral bores about the central bore is non-symmetrical.

In some embodiments, the non-circular shape of the interior volume of the main body and the cavity of the brake backing plate provides for an increased volume of an air chamber of the muzzle brake apparatus, which reduces recoil and muzzle rise conditions during an operation of the firearm including a discharge of the projectile from the firearm.

In some embodiments, a majority of the peripheral bores in the arrangement are above and below the central bore.

In some embodiments, the cavity of the brake backing plate is formed by a plurality of filleted edges.

In another aspect, a firearm comprises a gas impingement system and a muzzle brake apparatus. The muzzle brake apparatus comprises a main body having a central bore and a plurality of peripheral bores about the central bore, the central bore extending a flow path for a projectile from a barrel of a firearm and an exit for the projectile; and a brake backing plate coupled to the main body, the brake backing plate constructed and arranged for coupling to a distal end of the barrel of the firearm, the brake backing plate including a cavity having a first volume for receiving a flow of gas in the flow path of the barrel, wherein the peripheral bores output a first portion of gas from the firearm, and wherein a second portion of the gas is returned to the barrel to engage the gas impingement system.

DETAILED DESCRIPTION OF THE EMBODIMENTS

In the following description, specific details are set forth although it should be appreciated by one of ordinary skill that the systems and methods can be practiced without at least some of the details. In some instances, known features or processes are not described in detail so as not to obscure the present invention.

Some traditional muzzle brakes include a single cylindrical machined metal stock that includes a bore that is threaded at one end for attaching to the barrel of the firearm and the other end having a plurality of output side holes to reroute gasses, etc. The bore in this conventional design has a sufficient volume for storing or buffering the gasses and the smaller output side holes limit the gas flow. The volume and inner diameter of the bore is limited by the circular shape of the metal stock.

Other traditional muzzle brakes incorporate a two piece design, including a cylindrical outer piece having a threaded bore and an inner piece inside the bore, which includes a plurality of slots, generally along the sidewalls, in lieu of the smaller output ports of the single piece design. This configuration can hold a volume of gas but cannot meter the output other than by modifying the inner piece, in which case the pressure is limited so that the different between the interior pressure and ambient pressure causes a decrease in projectile velocity from the output of the barrel. In addition, sound is prevalent since there is no significant reduction in decibel levels. Neither brake design addresses the issue of muzzle rise.

Figure 1:
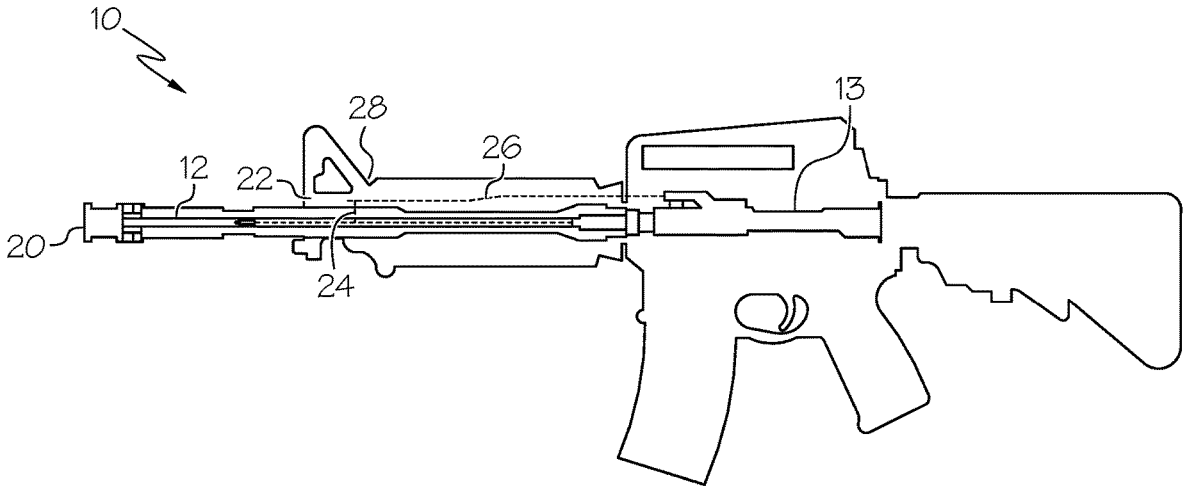
FIG. 1 is a cross-sectional side view of a rifle in which embodiments of the present inventive concepts can be taught.
Figure 2:
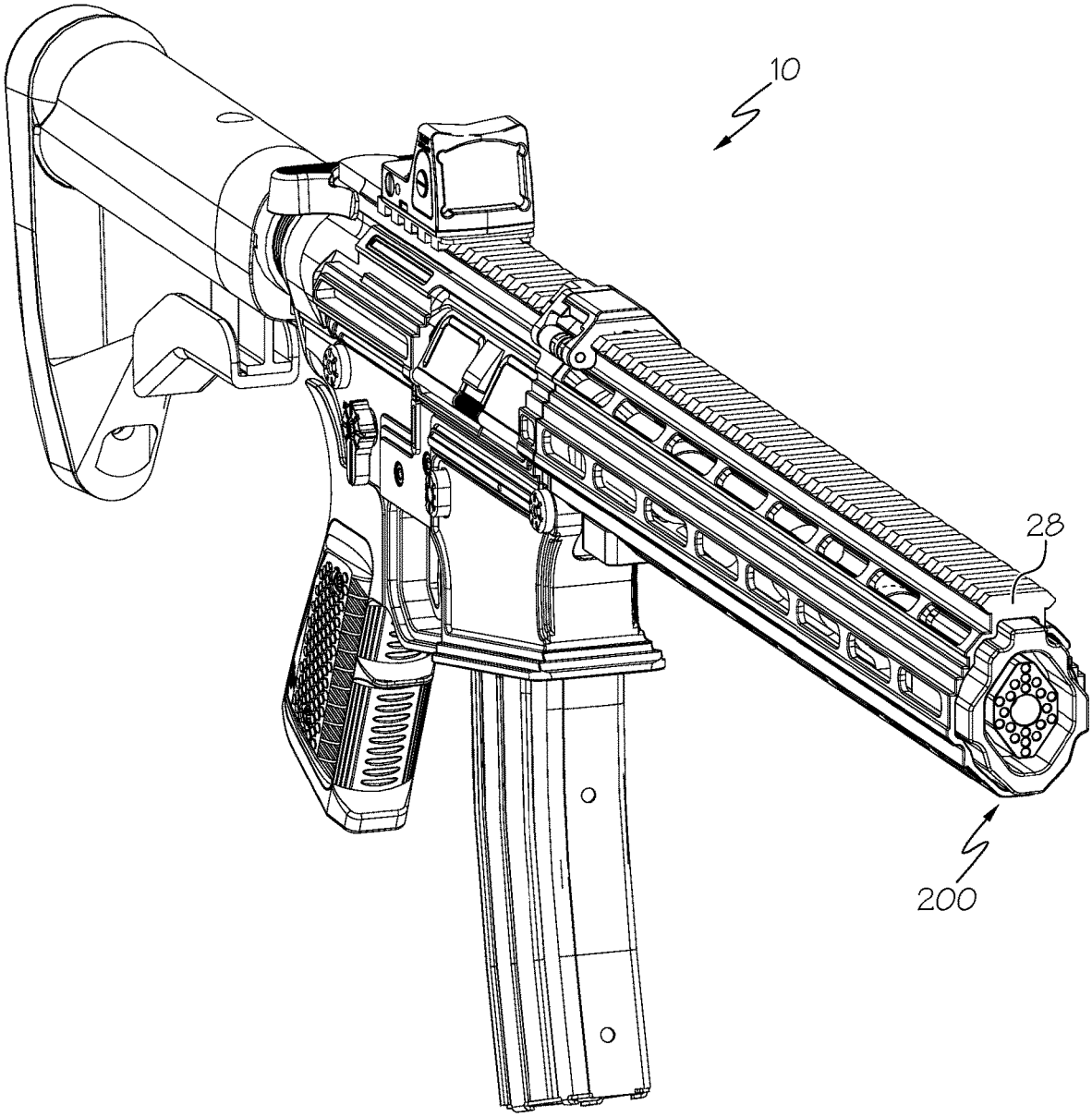
FIG. 2 is a perspective view of a firearm having a muzzle brake apparatus, in accordance with some embodiments of the present inventive concept.

FIG. 2 is a perspective view of a firearm 10 having a muzzle brake apparatus 200, in accordance with some embodiments of the present inventive concept. The firearm 10 can be an automatic or semi-automatic rifle, but not limited thereto. Well-known components and features of the firearm 10 are not described herein due to brevity.

Figure 3:
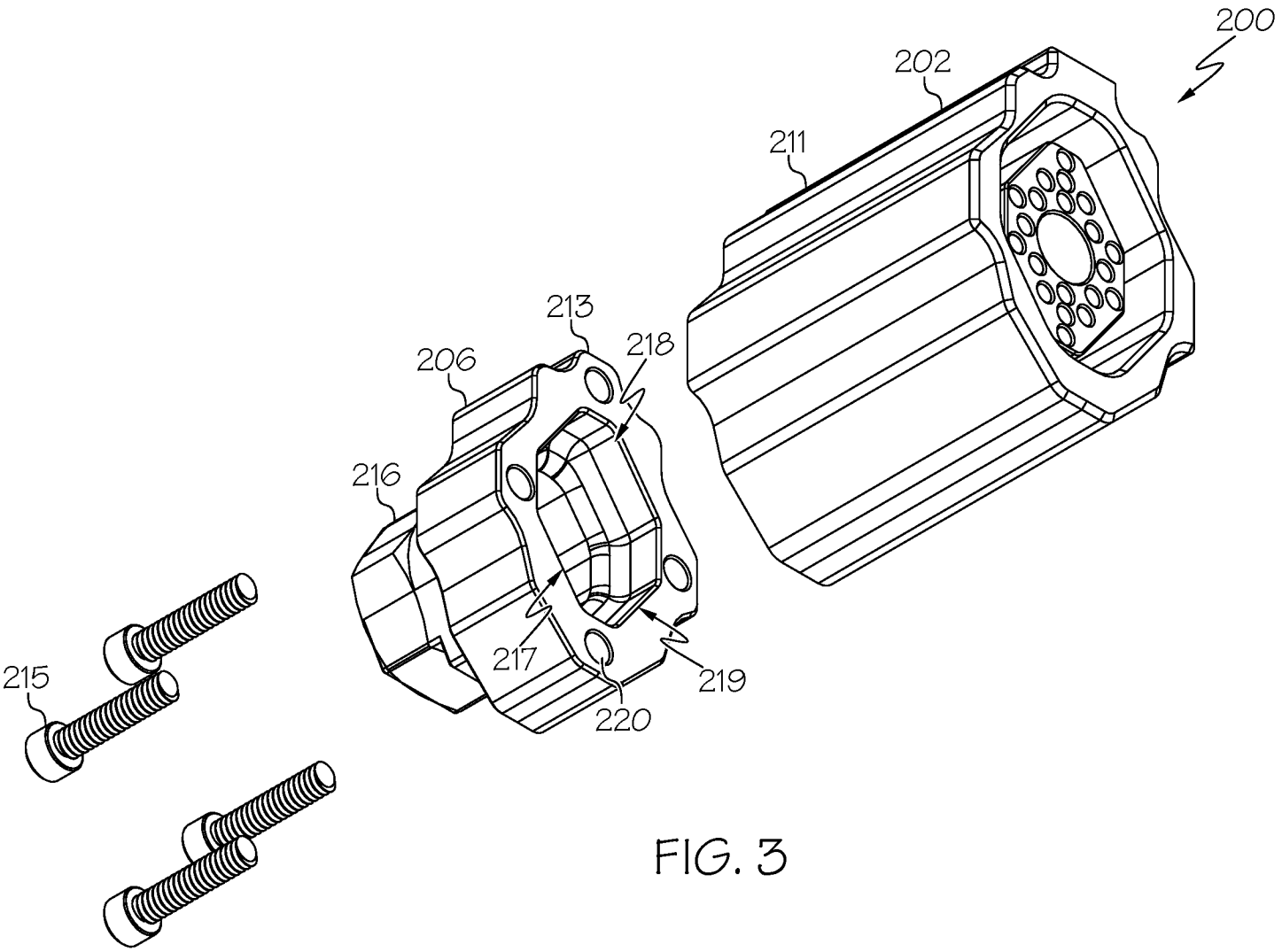
FIG. 3 is an exploded perspective view of a distal end of the muzzle brake apparatus of FIG. 2, in accordance with some embodiments of the present inventive concept.

In some embodiments, the muzzle brake assembly 200 may be machined, molded, or otherwise formed from stock as a unitary piece formed of metal or similar material. In other embodiments, the muzzle brake assembly 200 may be formed of multiple elements, e.g., main body 202 and a brake backing plate 206 shown in FIGS. 3 and 4, that are machined, molded, or otherwise formed independently from each other and coupled together, for example, glued, bonded, pressed, and/or welded together.

Figure 4:
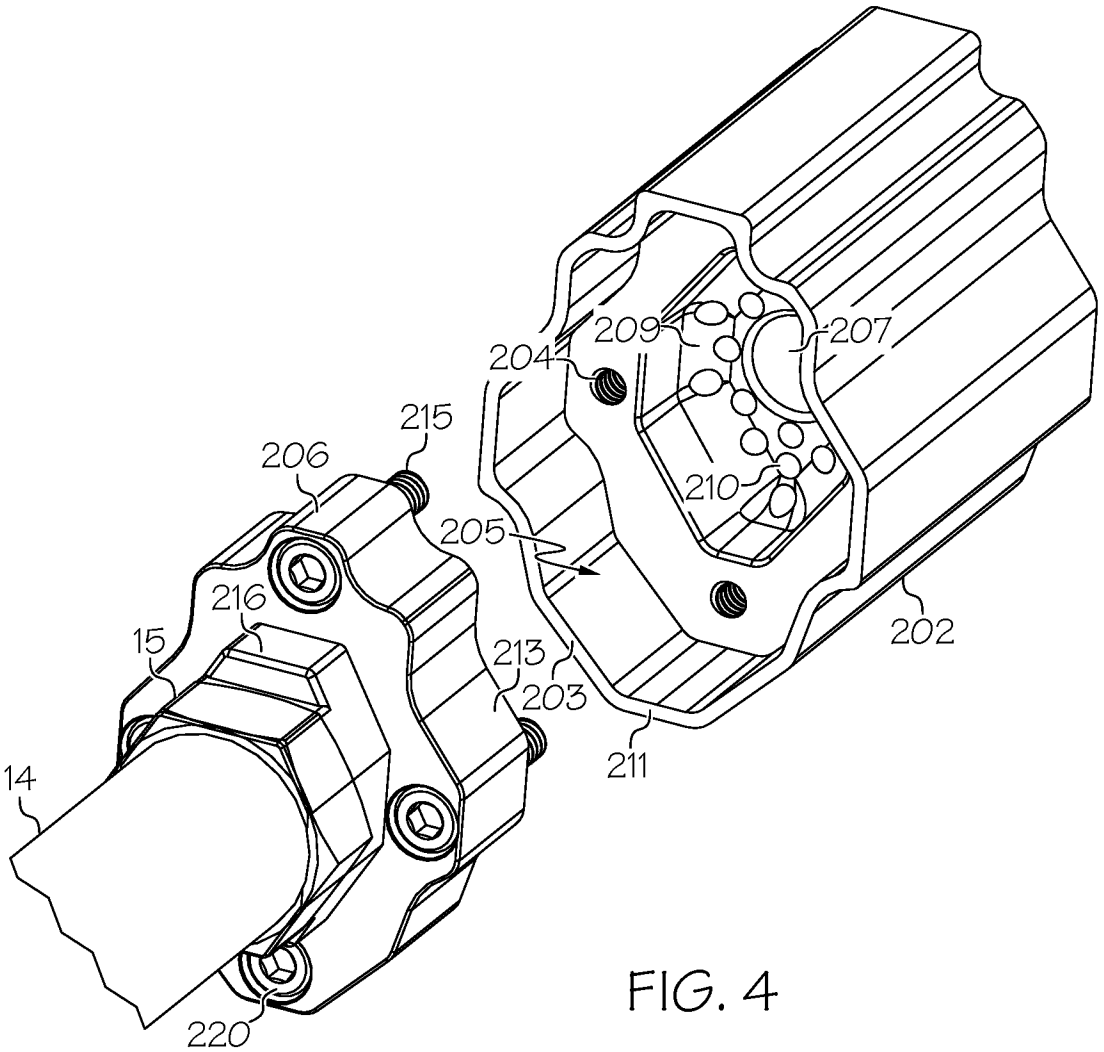
FIG. 4 is a perspective rear view of the muzzle brake apparatus of FIGS. 2 and 3.
Figure 5:
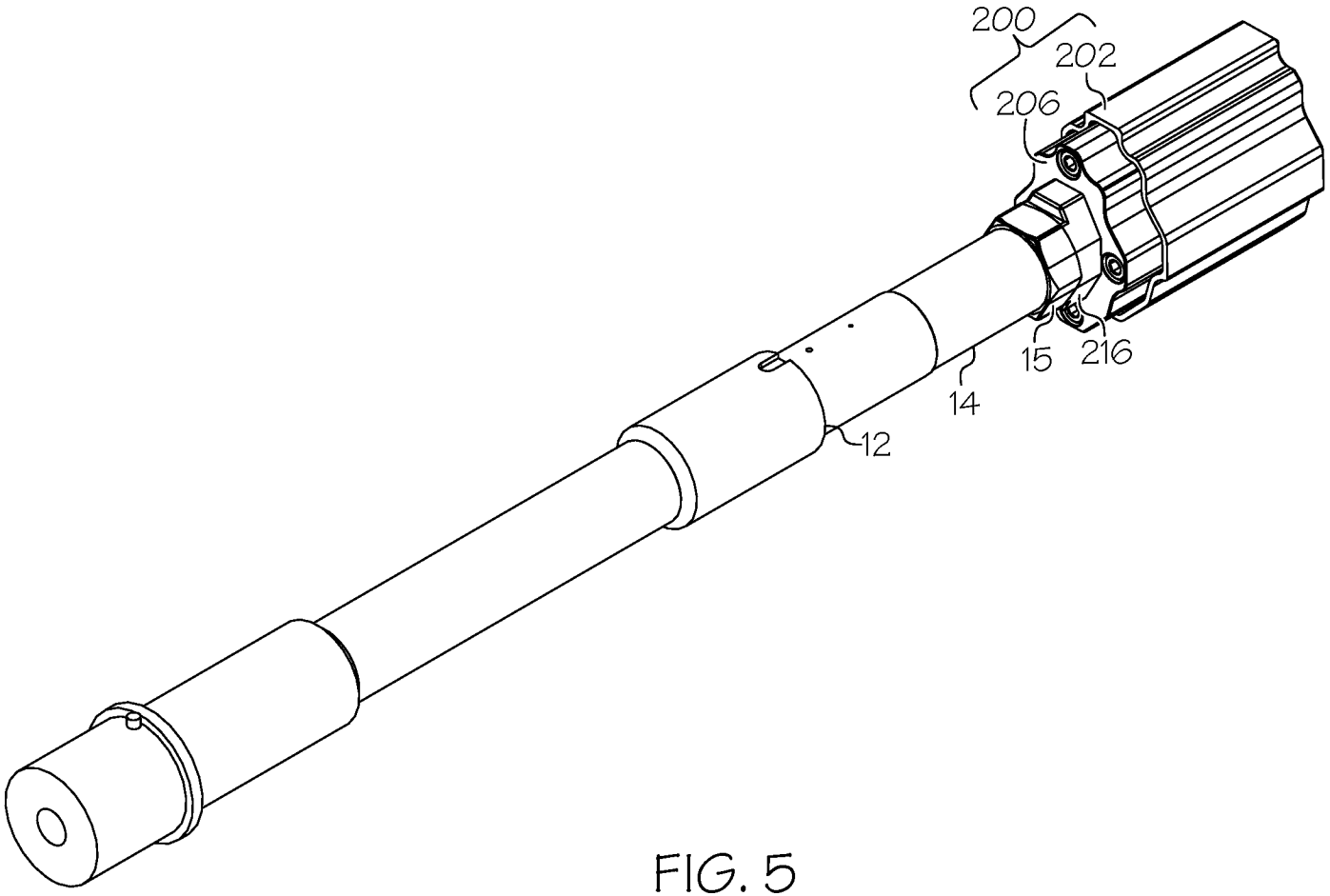
FIG. 5 is a perspective view of the muzzle brake apparatus of FIGS. 2-4 coupled to a barrel of the firearm, in accordance with some embodiments of the present inventive concept.
Figure 6:
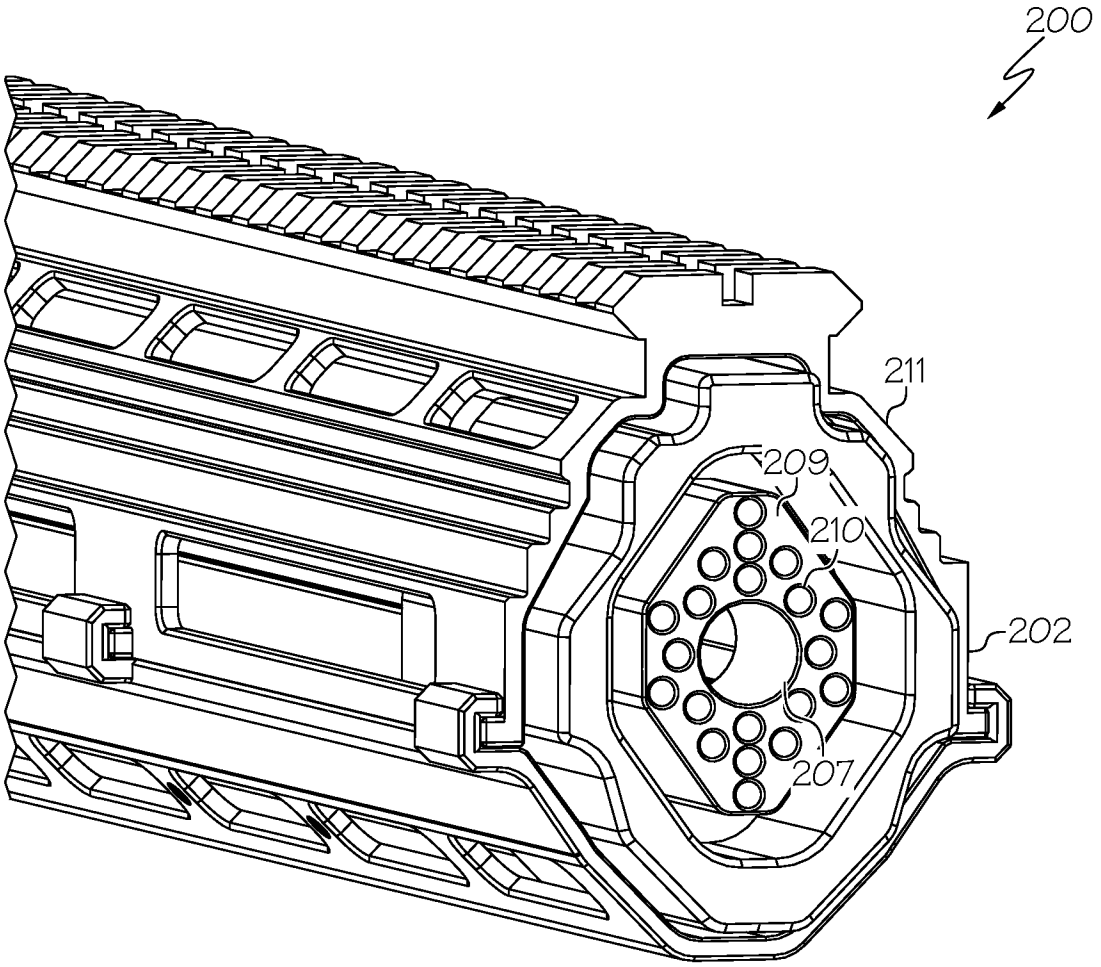
FIG. 6 is an assembled perspective view of the distal end of the firearm of FIGS. 2-5, in accordance with some embodiments of the present inventive concept.

As shown in FIGS. 4-6, the muzzle brake apparatus 200 is constructed and arranged for secure and direct coupling to a distal end 14 of the firearm barrel 12, either by a threaded connection, e.g., bolts 215 extending from the barrel 12 for mating with threaded holes 220 in the brake backing plate 206 and threaded holes 204 in the main body 202, or other fastener or connection apparatus and/or technique suitable for providing a removable direct secure connection between the barrel end 14 and the muzzle brake apparatus 200.

As described herein, the barrel distal end 14 and muzzle main body 202 are each shaped to conform with the distal end 14 of the firearm barrel 12. The main body 202 may have a diamond-shape, polygon-shape, or related configuration, for example, comprising a plurality of lobes 211 or related protrusions or non-circular shape configuration which define the configuration of the distal end opening 205 of the main body 202, which in turn is inserted into or otherwise at least partially surrounded by the handguard 28. The shape of the perimeter of the main body 202 permits the muzzle and barrel distal end 14 to prevent or mitigate muzzle rise, or to compensate for muzzle rise due at least in part due to the release of gasses along a vertical axis of the muzzle brake apparatus 200. The positioning and concentration of the majority of bores 210 along the vertical axis can achieve the effect of reduced muzzle rise or the like. The interior the handguard 28 includes grooves or other configurations to accommodate, e.g., that mate with or otherwise receive, the lobes 211 of the main body 202 and the distal end 14 of the barrel 12, for example, arranged to prevent or reduce undesirable rotational movement about the axis of the barrel 12 during operation, for example, discharging the firearm 10.

In some embodiments, the backing plate 206 provides a joint or other interface or union between the barrel 12 and the brake apparatus 200. The brake backing plate 206 coupled to a distal end 14 of the barrel 12 may have a width that is greater than that of the barrel 12 but also having a sufficient width for positioning in a distal end opening 205 of the main body 202. In some embodiments, the backing plate 206 has a nut-shaped extension 216 that is constructed and arranged for coupling to a jam nut 15 or the like at the distal end 14 of the barrel 14. The extension 216 can be machined from a same metal stock as the backing plate 206, or formed separately and coupled to a wall surface of the backing plate 206 by bonding, welding, and so on. The extension 216 is shaped to include a plurality of flats, i.e., forming the nut shape, for use by a wrench or other tool to separate the muzzle brake apparatus 200 from the barrel 12 or to attach the muzzle brake apparatus 200 to the barrel 12. At least a portion of the distal end 14 of the barrel 12 may be threaded (not shown) and the backing plate extension 216 may include threads for mating with the barrel and for interfacing with the jam nut 15. The interface between the jam nut 15 and the extension 216 may include sealing elements for forming a seal and reducing or preventing the escape of gasses, sound, and so on from the interface.

The backing plate 206 may have a non-circular shape constructed and arranged for positioning in the distal end opening 205 of the main body 202 of the muzzle brake apparatus 200. For example, a perimeter of the backing plate 206 may have a plurality of lobes 211 or related shaped features, e.g., flower petal-like shape similar to that of the distal end opening 205 of the main body 202. In another example, the shape may include a central region, for example, cylindrical, elliptical, or the like, with a plurality of peripheral regions radiating or extending from or otherwise about the central region, where the peripheral regions can have rounded surfaces. As described herein, the shape of the backing plate 206 and main body 202 offer unique functional advantages with respect to surface area, gas distribution, and volume increase. For example, the non-circular external shape of the muzzle brake 200 allows gas to be dispersed more efficiently, and as described here, can allow the system to be tuned according to a predetermined number of peripheral bores 210, which are small holes surrounding a larger central bore 207, and hence the term "peripheral". Other tuning features may include holes configured to operate as air pockets, brake backing volume changes, and so on.

Referring again to FIG. 3, the backing plate 206 includes a central bore 217, a cavity 218, and plurality of rolled or filleted edges 219. The central bore 217, also referred to as a central channel or aperture, extends through the length of the backing plate 206 for providing a projectile flow path from the barrel 12 of the firearm 10. The central bore 217 is aligned with the length of the barrel 12 via the jam nut 15 and the extension 216 to receive projectiles, gasses, and/or energy, e.g., sound, forces, etc. output from the barrel 12. The central bore 217 may have a well-known shape for receiving a projectile, e.g., a bullet, from the barrel bore, which may have a configuration similar to or the same as the muzzle's central bore 217, e.g., oval, elliptical, cylindrical, comprising grooves or the like, and so on, but not limited thereto.

The cavity 218 when coupled to the main body 202 form an additional volume, also referred to as an air pocket or air chamber 222 (see FIG. 7C), with the distal end opening 205 of the main body 202 that is greater than the volume of the distal end opening 205 alone. The cavity 218 communicates with the central bore 217 to exchange projectiles to the main body 202, but also to receive gasses from the barrel 12. In some embodiments, the cavity extends between the muzzle brake and the barrel 12 to expand the air coming from the barrel 12 substantially before the muzzle brake. The cavity 218 stores the extra volume of gasses as the gasses are output the peripheral bores 210 in the main body 202. Without the volume offered by the cavity 218, gas movement would be limited to the peripheral bores 210 and related factors such the length of the main body 202, size of the holes 210, and so on. The extra volume offered by the cavity 218 allows for more pressure and therefore more volume with respect to the gasses generated during firearm operation. The filleted edges 219 of the cavity 218 are constructed and arranged to mitigate or prevent undesirable eddying effects or the like inside the muzzle brake 200.

In some embodiments, the peripheral bores 210 extend through an interior portion 209 that is machined as part of the main body 202, i.e., forming a unitary or monolithic one-piece muzzle brake body 202, or is formed separately from the outer main body 202 and press-fit and then welded to an end of the outer main body 202. The peripheral bores 210, also referred to as channels or apertures, are positioned about and parallel to a central bore 207. The peripheral bores 210 have a width, circumference, shape, and/or other dimension that is different than the central bore 207. In some embodiments, the peripheral bores 210 have a diameter smaller than a diameter of the central bore 207. The peripheral bores 210 provide a passageway for gases to escape forward of the muzzle brake 200. This has the benefit of greatly reducing the sound, i.e., decibel level, of the firearm after a round is fired. The sound is sent forward of the firearm and away from the operator and those standing next to or behind the operator. In addition, the peripheral bores 210 also relieves pressure caused by the hot gasses output from the barrel 12 to the muzzle brake apparatus 200, and in doing so conserves more gas which is returned back up the barrel 12 to engage the gas impingement system, and therefore making it more reliable. The arrangement of peripheral bores 210 is also important for reducing undesirable recoil and muzzle rise during operation of the firearm 10. In some embodiments, the porting, e.g., number of bores 210, is increased at the top and bottom regions of the main body 202, and is non-symmetrical or otherwise has an asymmetric shape as compared to the porting arrangement at the sides of the main body 202. For example, as shown in FIGS. 4 and 6, there is a greater number of peripheral bores 210 at the 12 o'clock and 6 o'clock positions, i.e., above and below the central bore 207 as compared to the 3 o'clock and 9 o'clock positions. The non-circular shape of the main body 202 also contributes to the asymmetric or non-symmetric arrangement of peripheral bores 210. Conventional round muzzle brakes are constructed for symmetrical porting arrangements about the center bore.

The central bore 207, also referred to as a central channel or aperture or bullet exit, extends through the length of the interior element 209 of the main body 202 and is aligned with the central bore 217 of the backing plate 206 for providing a projectile flow path from the barrel of the firearm. The central bore 207 extends along a same axis the length of the barrel 12 to receive projectiles, gasses, and/or energy, e.g., sound, forces, etc. output from the barrel 12. The central bore 207 may have a well-known shape for receiving a projectile, e.g., a bullet, from the barrel bore, which may have a configuration similar to or the same as the backing plate's central bore 217, e.g., oval, elliptical, cylindrical, comprising grooves or the like, and so on, but not limited thereto.

In preferred embodiments, the main body 202 does not include side ports, vents, or the like for outputting gas but is instead a solid unitary housing with a hollow region, opening, or the like, for the interior portion 209, which as described herein is preferably constructed from the same block or source of material forming the solid unitary housing surrounding the interior portion 209. A combination of the peripheral bores 210 and the cavity 218 of the backing plate 206 described herein operate to dispense some gasses generated by the firearm 10 during operation. This feature also reduces the sound by directing the sound so that the person next to a firearm user is not in the path of sound energy otherwise output from side vents, which may not be present in the muzzle 200.

The interior portion 209 may also include threaded holes 204 for receiving bolts 215 or related threaded elements extending from the backing plate 206, which couple the backing plate 206 to the wall of the interior portion 209 inside the distal end opening 205 of the main body 202. In some embodiments, the holes 204 in the interior portion 209 are not threaded but instead serve as guide lumens for receiving and mating with non-threaded elongated elements 215 extending from the barrel 12.

During operation after firing the gun, the exploded gasses travel down and expand inside the barrel 12 until they reach the air chamber 222, where a portion of the gasses continue to travel down the central bore 207 with the projectile as well as the peripheral bores 210 and another portion of the gasses is redirected by a wall 209 of the interior portion (see FIG. 4) of the main body 205 which forms the air pocket having the increased volume and surface area due to the cavity 218, and which provides efficiency and reduction of wear and tear on the gas impingement system. This is because the unique non-circular shape of the muzzle brake 200 allows gas to be dispersed more efficiently, and allows the apparatus 200 to be tuned according to characteristics of the firearm, for example, by changing the configuration of peripheral bores 210, volume of the air pocket 218 and/or 205, etc. In accordance with Boyle's Law, which establishes a mathematical relationship between gas volume and pressure, the cavity 218 of the backing plate 206 can store the extra volume, or function as a buffer, with respect to gasses as the gasses are slowed down through the peripheral bores 210. Without the extra volume offered by the cavity 218, gas movement would be limited to the size, number, and shape of the peripheral bores 210. The extra volume offered by the air chamber 222 allows for additional gas pressure and volume, which addresses the inverse relationship between pressure and volume in accordance with Boyle's Law. For example, high pressure in the pocket area 218 moves to the proximal region of the main body 202 through the peripheral bores 210. Pressure changes caused by a projectile being expelled causes the gasses, e.g., air, in the pocket 218 to follow out the exit and quickly clear the pocket 218. High pressure in the pocket chases the low pressure from the exit of the projectile. Accordingly, the additional volume offered by the pocket 218 combined with the additional number and arrangement of peripheral bores 210 results in less pressure inside the muzzle brake 200. The air chamber 222 formed by the cavity 218 and distal end 205 expands the air received from the barrel 12 substantially before output from the muzzle brake via the peripheral bores 210. In some embodiments, the air chamber 222 is formed from the backing plate cavity 218 inserted in the distal end opening 205 of the main body 202 and the exterior surface of the backing plate 206 directly abuts the interior wall 209 of the main body 202 at locations 223 shown in FIG. 7C.

Another advantage is that air conservation occurs through the expansion chamber 222. For example, since the air expands in the pocket and a large amount of the air are output the peripheral holes 210, a portion of the air expands and returns to the barrel 12, which improves efficiency with respect to the air.

Another advantage is improved balance due to the recoil caused by the muzzle brake 200 directed along the same axis as the barrel 12, which reduces undesirable deviations from the axis that otherwise cause muzzle rise to occur.

Figure 7A:
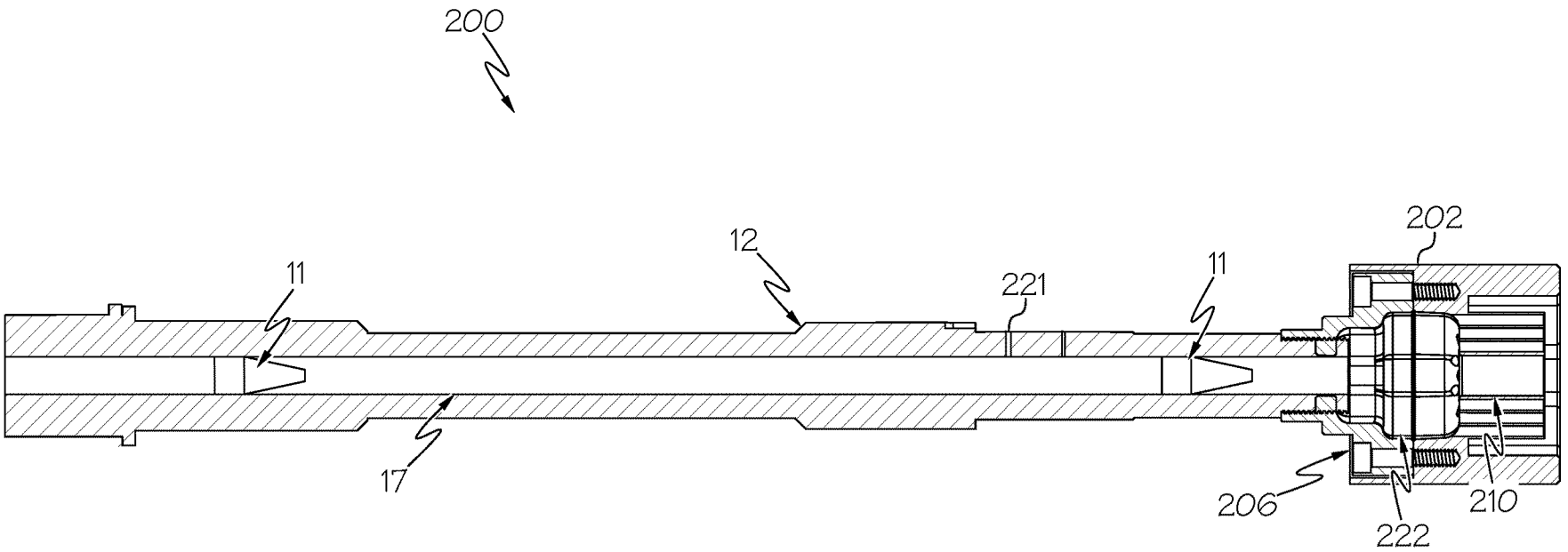
FIG. 7A is a cross-sectional side view of a cross-section of the muzzle brake apparatus and barrel of FIG. 5.
Figure 7B:
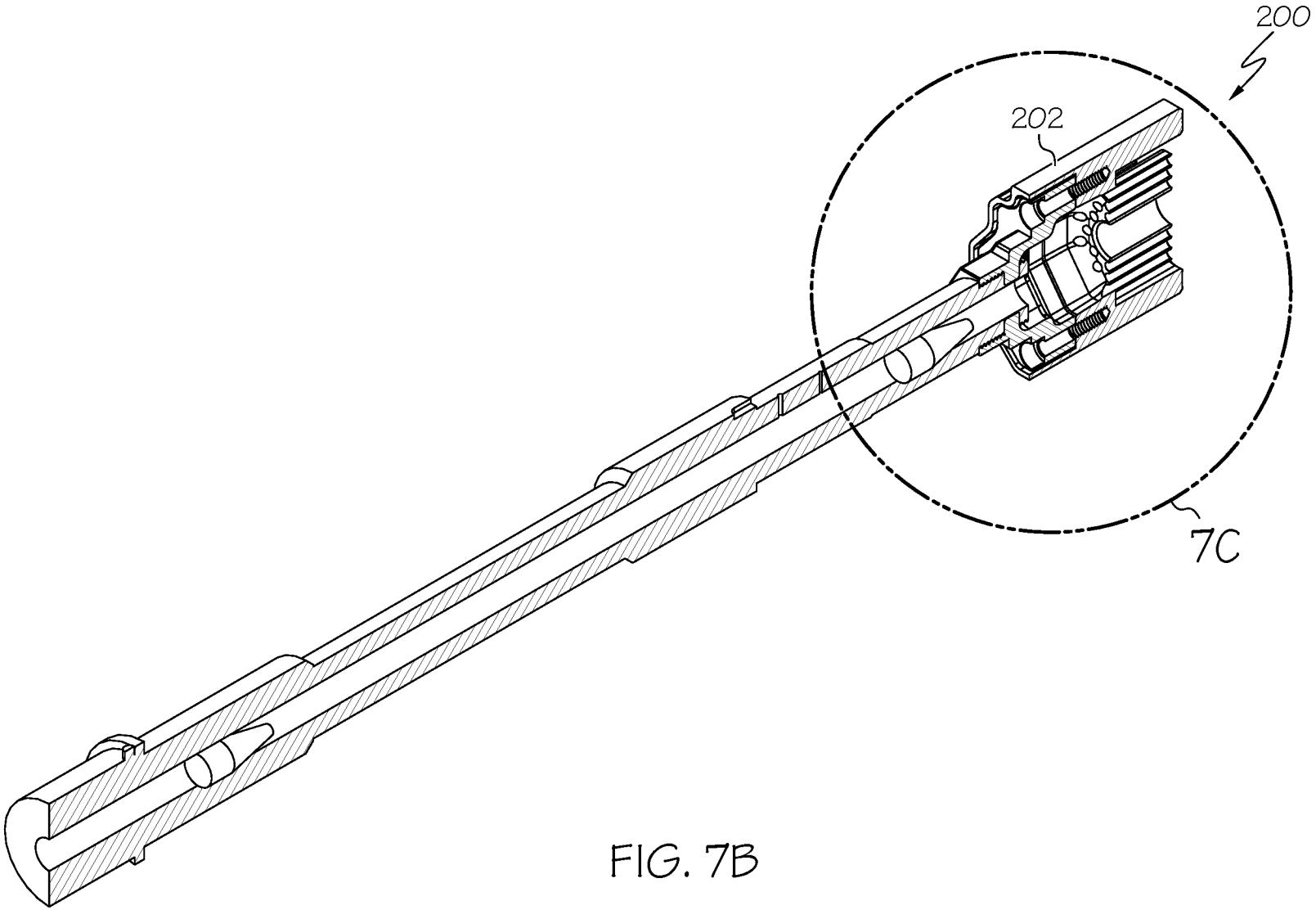
FIG. 7B is a cross-sectional perspective view of a cross-section of the muzzle brake apparatus and barrel of FIGS. 5 and 7A.
Figure 7C:
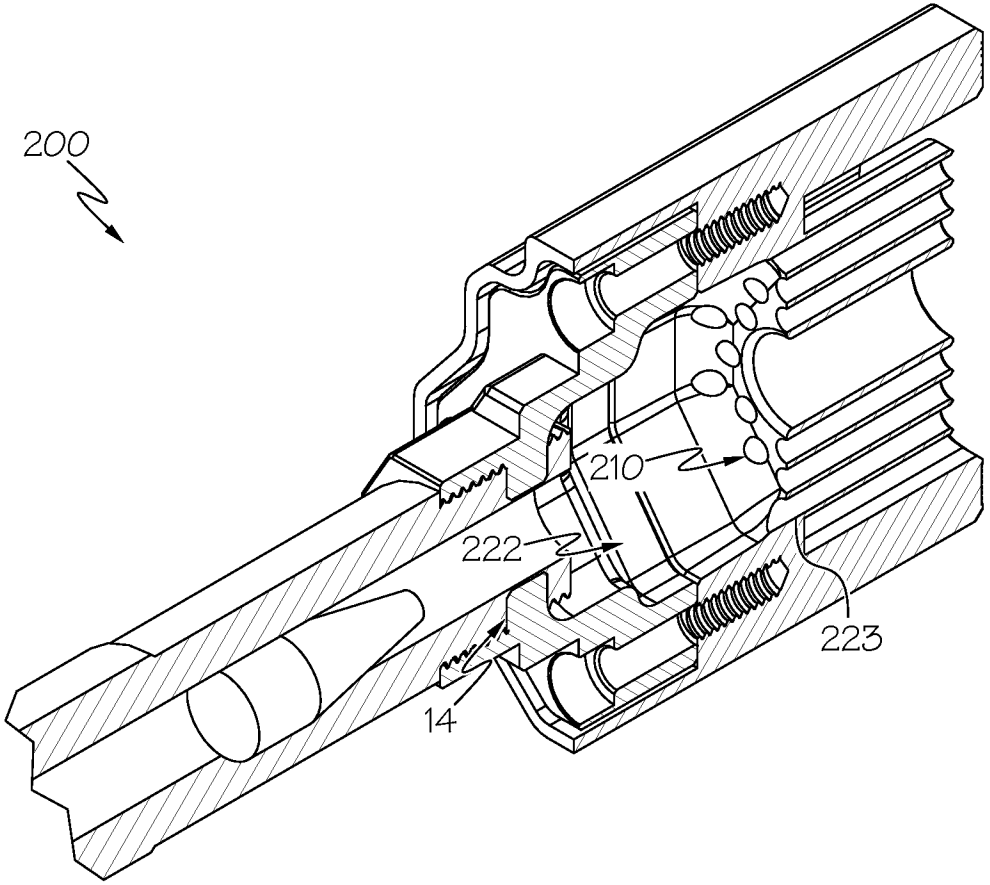
FIG. 7C is a closeup view of the muzzle brake apparatus and barrel of FIG. 7B.

These advantages are further illustrated in FIGS. 7A-7C. As a bullet 11 travels down the barrel lumen along a the length of the barrel 12, it is propelled by force, pressure and gasses behind the bullet 11. The force results in high pressure inside the barrel lumen 17. In some embodiments, the barrel 12 includes one or more holes 221 aligned with the gas block 26 to dispel a portion of the gasses in the barrel 12. The hole 221 can direct this exerted gas pressure into the upper receiver and aid in reloading a next bullet. As the bullet 11 exits the barrel, for example, at distal end 14, the pressure transitions to low pressure, and an audible sound is generated. The muzzle 200 is constructed and arranged to reduce the velocity of the gasses and reroute the gas pressure, whereby the undesirable sound is reduced, for example, by 10-15 db or more, or omitted. Here, the air chamber 222 creases an area of low pressure and allows the gasses to be released in the chamber 222 before being regulated and rerouted through the smaller holes 210 to the ambient environment, e.g., the atmosphere. In addition, by rerouting the ongoing gases according to embodiments described by way of example herein, recoil and muzzle rise can be reduced and/or controlled or tuned by adding holes 210, changing the shape of the holes 210, for example, rectangle-shaped holes, increasing the width, diameter, or other dimension of the holes 210 to achieve a desired setting.

Further, as shown in FIG. 6, a midline (M) extends horizontally across the center of the central bore 207. The majority of the holes 210 are above and below the centerline to provide a counterforce to aid against muzzle rise or a wandering barrel. Forces created from the bullet 11 cause the end of the barrel 12 to lift or rise. The holes 210 above and below the central bore midline (M) relieve the pressure change. The holes 210 communicate with the backing plate 206 to hold more volume and permit the rerouting or redirecting of the gases and forces to counteract muzzle rise. Different caliber weapons have different requirements. Accordingly, the muzzle brake 200 is tunable in that different size bores, different propellants, length, volume, and so on can be modified to accommodate changes in weapon caliber while minimizing undesirable muzzle rise.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

What is claimed is:

1. A muzzle brake apparatus, comprising:

a main body having a central bore and a plurality of peripheral bores about the central bore, the central bore extending a flow path for a projectile from a barrel of a firearm and an exit for the projectile; and a brake backing plate coupled to the main body, the brake backing plate constructed and arranged for coupling to a distal end of the barrel of the firearm, the brake backing plate including a cavity having a first volume for receiving a flow of gas in the flow path of the barrel, wherein the peripheral bores extend along a length of the main body parallel to the central bore to a distal end of the main body to output a first portion of gas from the barrel, and wherein the central bore outputs a second portion of the gas.

2. The muzzle brake apparatus of claim 1, wherein the peripheral bores in the main body have a second volume, and wherein the muzzle brake apparatus includes a volume comprising the first volume and the second volume.

3. The muzzle brake apparatus of claim 2, wherein the brake backing plate includes an air chamber that expands a volume of the flow of gas received from the barrel before the first portion of gas enters the peripheral bores.

4. The muzzle brake apparatus of claim 1, wherein the main body has a peripheral surface area that prevents the flow of gas from output through the peripheral surface, and so that the flow of gas can only exit the muzzle brake apparatus from the central bore and the plurality of peripheral bores.

5. The muzzle brake apparatus of claim 4, wherein the peripheral surface of the main body, an interior volume of the main body, and the cavity of the brake backing plate each has a non-circular shape.

6. The muzzle brake apparatus of claim 5, wherein the non-circular shape of the peripheral surface of the main body accommodates a positioning of a handguard of the firearm about the main body.

7. The muzzle brake apparatus of claim 1, wherein an arrangement of a first plurality of bores of the plurality of peripheral bores above and below the central bore is non-symmetrical to a second plurality of bores relative to left and right of the central bore.

8. The muzzle brake apparatus of claim 5, wherein the non-circular shape of the interior volume of the main body and the cavity of the brake backing plate provides for an increased volume of an air chamber of the muzzle brake apparatus, which reduces recoil and muzzle rise conditions during an operation of the firearm including a discharge of the projectile from the firearm.

9. The muzzle brake apparatus of claim 1, wherein a majority of the peripheral bores in the arrangement are above and below the central bore.

10. The muzzle brake apparatus of claim 1, wherein the cavity of the brake backing plate is formed by a plurality of filleted edges.

11. A firearm, comprising:

a gas impingement system; and a muzzle brake apparatus, the muzzle brake apparatus comprising:

a main body having a central bore and a plurality of peripheral bores about the central bore, the central bore extending a flow path for a projectile from a barrel of a firearm and an exit for the projectile; and a brake backing plate coupled to the main body, the brake backing plate constructed and arranged for coupling to a distal end of the barrel of the firearm, the brake backing plate including a cavity having a first volume for receiving a flow of gas in the flow path of the barrel, wherein the peripheral bores output a first portion of gas from the firearm, and wherein the central bore outputs a second portion of the gas.

12. The firearm of claim 11, wherein the peripheral bores relieves pressure caused by the flow of gas and conserves the second portion of gas provided to the gas impingement system.

13. A muzzle brake apparatus, comprising:

a main body having a central bore and a plurality of peripheral bores about the central bore, the central bore extending a flow path for a projectile from a barrel of a firearm and an exit for the projectile; and a brake backing plate coupled to the main body, the brake backing plate constructed and arranged for coupling to a distal end of the barrel of the firearm, the brake backing plate including a cavity having a first volume for receiving a flow of gas in the flow path of the barrel, wherein the peripheral bores output a first portion of gas from the firearm, wherein the central bore outputs a second portion of the gas, wherein the peripheral surface of the main body, an interior volume of the main body, and the cavity of the brake backing plate each has a non-circular shape, and wherein the non-circular shape of the peripheral surface of the main body accommodates a positioning of a handguard of the firearm about the main body.

14. A muzzle brake apparatus, comprising:

a main body having a central bore and a plurality of peripheral bores about the central bore, the central bore extending a flow path for a projectile from a barrel of a firearm and an exit for the projectile; and a brake backing plate coupled to the main body, the brake backing plate constructed and arranged for coupling to a distal end of the barrel of the firearm, the brake backing plate including a cavity having a first volume for receiving a flow of gas in the flow path of the barrel, wherein the peripheral bores output a first portion of gas from the firearm, wherein the central bore outputs a second portion of the gas, wherein the peripheral surface of the main body, an interior volume of the main body, and the cavity of the brake backing plate each has a non-circular shape, and wherein the non-circular shape of the interior volume of the main body and the cavity of the brake backing plate provides for an increased volume of an air chamber of the muzzle brake apparatus, which reduces recoil and muzzle rise conditions during an operation of the firearm including a discharge of the projectile from the firearm.

* * * * *